US009564022B2

(12) United States Patent
Jaffe et al.

(10) Patent No.: US 9,564,022 B2
(45) Date of Patent: Feb. 7, 2017

(54) VARIABLE-SPEED WAGERING GAME INSTANCE INITIATION

(71) Applicant: WMS Gaming Inc., Waukegan, IL (US)

(72) Inventors: Joel R. Jaffe, Glenview, IL (US); Dion K. Aoki, Chicago, IL (US); Jamie W. Vann, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 311 days.

(21) Appl. No.: 14/492,696

(22) Filed: Sep. 22, 2014

(65) Prior Publication Data

US 2015/0087393 A1 Mar. 26, 2015

Related U.S. Application Data

(60) Provisional application No. 61/960,667, filed on Sep. 23, 2013.

(51) Int. Cl.
*G07F 17/34* (2006.01)

(52) U.S. Cl.
CPC ..... *G07F 17/34* (2013.01)

(58) Field of Classification Search
USPC ..... 463/20, 22
See application file for complete search history.

(56) References Cited

U.S. PATENT DOCUMENTS 4,856,787 A 8/1989 Itkis
5,823,873 A 10/1998 Moody
5,976,016 A 11/1999 Moody et al.
5,997,401 A 12/1999 Crawford
6,098,985 A 8/2000 Moody
6,120,378 A 9/2000 Moody et al.
6,159,095 A 12/2000 Frohm et al.
6,203,428 B1 3/2001 Giobbi et al.
6,270,412 B1 8/2001 Crawford et al.
6,311,978 B1 11/2001 Moody
6,315,291 B1 11/2001 Moody
6,364,313 B1 4/2002 Moody
6,419,578 B1 7/2002 Moody et al.
6,517,074 B1 2/2003 Moody et al.
6,561,898 B2 5/2003 Moody
6,568,680 B1 5/2003 Moody et al.
6,652,377 B1 11/2003 Moody
6,652,378 B2 11/2003 Cannon et al.
6,656,040 B1 12/2003 Brosnan et al.
6,672,959 B2 1/2004 Moody et al.
6,755,738 B2 6/2004 Glasson et al.
6,832,957 B2 12/2004 Falconer
6,860,810 B2 3/2005 Cannon et al.
6,921,334 B1 7/2005 Bennett
(Continued)

FOREIGN PATENT DOCUMENTS

AU 738686 B2 3/1999
GB 2327794 A 2/1999
(Continued)

*Primary Examiner* — Pierre E Elisca
(74) *Attorney, Agent, or Firm* — Nixon Peabody LLP

(57) ABSTRACT

A method of conducting a wagering game includes player-controlled, dynamically determined wagering rates, with each wager initiating a separate instance of the wagering game and further displays concurrently executing instances together on one or more display devices.

20 Claims, 11 Drawing Sheets

(56) References Cited

U.S. PATENT DOCUMENTS

| | | | |
|---|---|---|---|
| 6,955,356 | B2 | 10/2005 | Moody |
| 6,964,418 | B2 | 11/2005 | Moody |
| 7,137,628 | B2 | 11/2006 | Moody |
| 7,156,735 | B2 | 1/2007 | Brosnan et al. |
| 7,222,857 | B2 | 5/2007 | Moody |
| 7,351,146 | B2 | 4/2008 | Kaminkow |
| 7,404,762 | B2 | 7/2008 | Moody |
| 7,431,644 | B2 | 10/2008 | Moody |
| 7,488,251 | B2 | 2/2009 | Kaminkow |
| 7,513,828 | B2 | 4/2009 | Nguyen et al. |
| 7,527,557 | B2 | 5/2009 | Jackson |
| 7,594,851 | B2 | 9/2009 | Falconer |
| 7,625,280 | B2 | 12/2009 | Singer et al. |
| 7,758,416 | B2 | 7/2010 | Randall |
| 7,806,764 | B2 | 10/2010 | Brosnan et al. |
| RE42,351 | E | 5/2011 | Bryant |
| 8,105,145 | B2 | 1/2012 | Jaffe |
| 8,109,821 | B2 | 2/2012 | Kovacs et al. |
| 8,118,657 | B2 | 2/2012 | Marks et al. |
| 8,246,443 | B2 | 8/2012 | Randall |
| 8,308,547 | B2 | 11/2012 | Walker et al. |
| 8,333,657 | B1 | 12/2012 | Nelson et al. |
| 8,388,435 | B2 | 3/2013 | Anderson et al. |
| 8,403,740 | B2 | 3/2013 | Kovacs et al. |
| 9,028,321 | B2 * | 5/2015 | Anderson ..... G07F 17/32 463/25 |
| 2003/0069064 | A1 | 4/2003 | Ainsworth |
| 2004/0043815 | A1 | 3/2004 | Kaminkow |
| 2005/0233794 | A1 | 10/2005 | Cannon et al. |
| 2006/0148547 | A1 | 7/2006 | Montgomery et al. |
| 2006/0172800 | A1 | 8/2006 | Kogo |
| 2008/0009334 | A1 | 1/2008 | Walker et al. |
| 2012/0184353 | A1 * | 7/2012 | Anderson ..... G07F 17/32 463/25 |

FOREIGN PATENT DOCUMENTS

| | | | |
|---|---|---|---|
| WO | WO9727570 | A1 | 7/1997 |
| WO | WO2006077383 | A1 | 7/2006 |

* cited by examiner

VARIABLE-SPEED WAGERING GAME INSTANCE INITIATION

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to a wagering game in which a player may determine how quickly, and how many, game instances are initiated and executing concurrently.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a computer-implemented method of conducting a wagering game comprises receiving, via at least one of one or more input devices, a first input indicative of a wager that initiates a first instance of the wagering game. The method further displays, via at least one of one or more display devices, a first changing array of symbols representing a plurality of possible first-instance outcomes. Prior to displaying a randomly selected first-instance outcome of the first instance, the method receives, via at least one of the one or more input devices and after a first delay period following the initiation of the first instance, a second input indicative of a wager that initiates a second instance of the wagering game. The first delay period is dynamically determined by the player. The method further displays a second changing array of symbols representing a plurality of possible second-instance outcomes while concurrently displaying the first changing array.

According to another aspect of the invention, a gaming system comprises one or more input devices, one or more display devices, one or more processors, and one or more memory devices. The memory devices store instructions that, when executed by at least one of the one or more processors, cause the gaming system to receive, a first input indicative of a wager that initiates a first instance of a wagering game. The instructions further cause the gaming system to display a first changing array of symbols representing a plurality of possible first-instance outcomes. Prior to a random selection of a first-instance outcome and after a first delay period following the initiation of the first instance, the gaming system receives a second input indicative of a second wager that initiates a second instance of the wagering game. The first delay period is dynamically determined by a player. The instructions further cause the gaming system to display, concurrently with the first changing array, a second changing array of symbols representing a plurality of possible second-instance outcomes.

According to yet another aspect of the invention, computer-readable storage media is encoded with instructions for directing a gaming system to perform a method comprising receiving a plurality of consecutive inputs that are each indicative of a wager initiating a separate instance of a wagering game. Each input of the plurality follows a previous input after a separate, dynamically-determined delay period, and is received prior to a random selection of an instance outcome corresponding to a previously initiated instance. The instructions further direct the gaming system to display, while at least one previously initiated instance is still executing and being displayed, one or more of the separate instances as a series of separate changing array of symbols representing pluralities of possible instance outcomes. Each separate changing array is first displayed at a first position and is sequentially moved to subsequent positions in response to the initiations of subsequent instances.

According to still another aspect of the invention, a computer-implemented method of conducting a wagering game comprises receiving a first input indicative of a wager that initiates a first instance of the wagering game, and displaying the first instance including a changing first array of symbols representing a plurality of possible first-instance outcomes. Prior to randomly selecting a first-instance outcome of the first instance and after a first delay period following the initiation of the first instance, the method further receives a second input indicative of a wager that initiates a second instance of the wagering game. The first delay period is dynamically determined by the player. The method further displays the second instance including a changing second array of symbols representing a plurality of possible second-instance outcomes, and the display of the second instance begins while the first array is still changing. The method stops the first array, while the second array continues changing, to display a first symbol combination representing the randomly selected first-instance outcome, and stops the second array to display a second symbol combination representing the randomly selected second-instance outcome.

Additional aspects of the invention will be apparent to those of ordinary skill in the art in view of the detailed description of various embodiments, which is made with reference to the drawings, a brief description of which is provided below.

Figure 1:
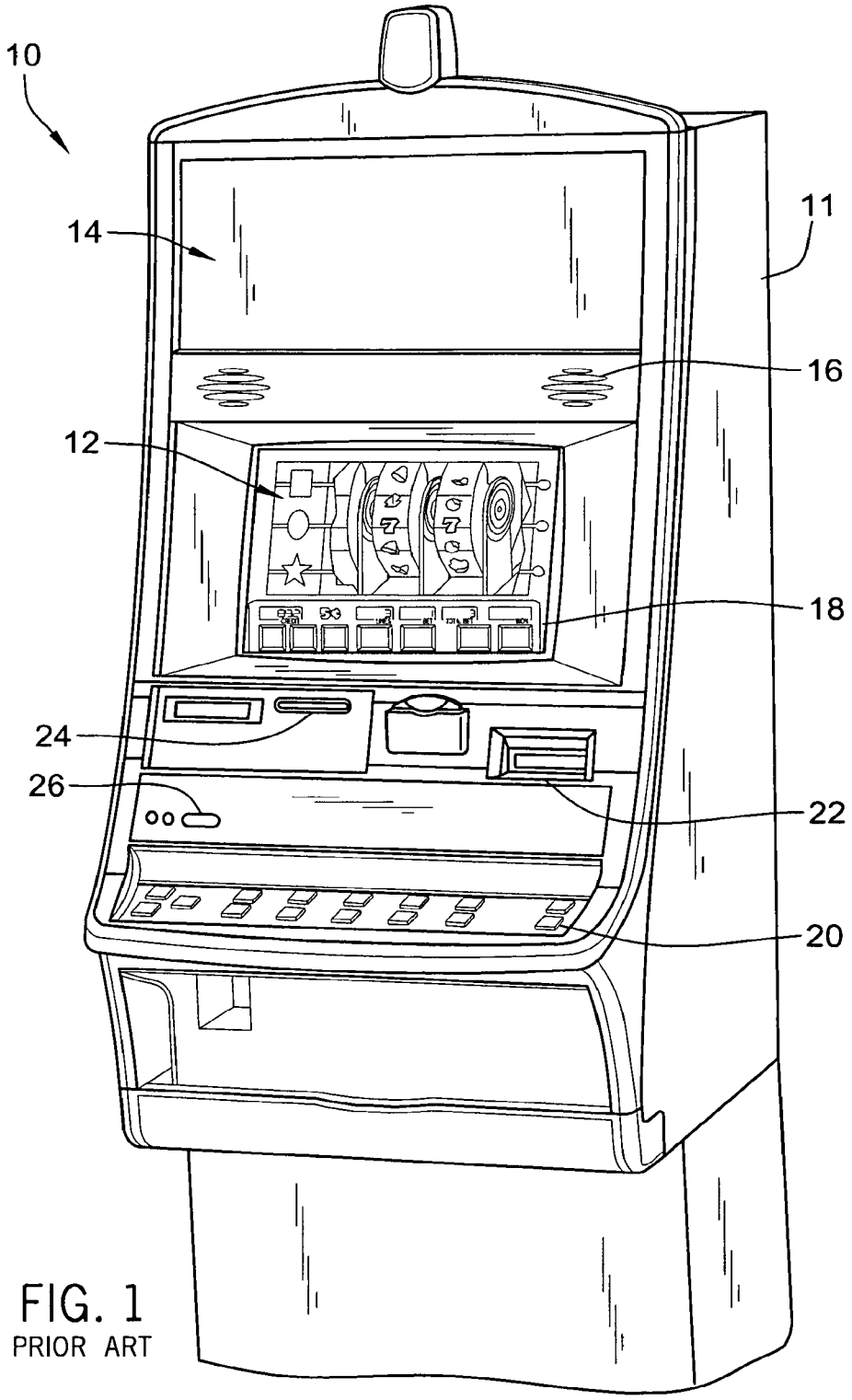
FIG. 1 PRIOR ART
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0069160 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
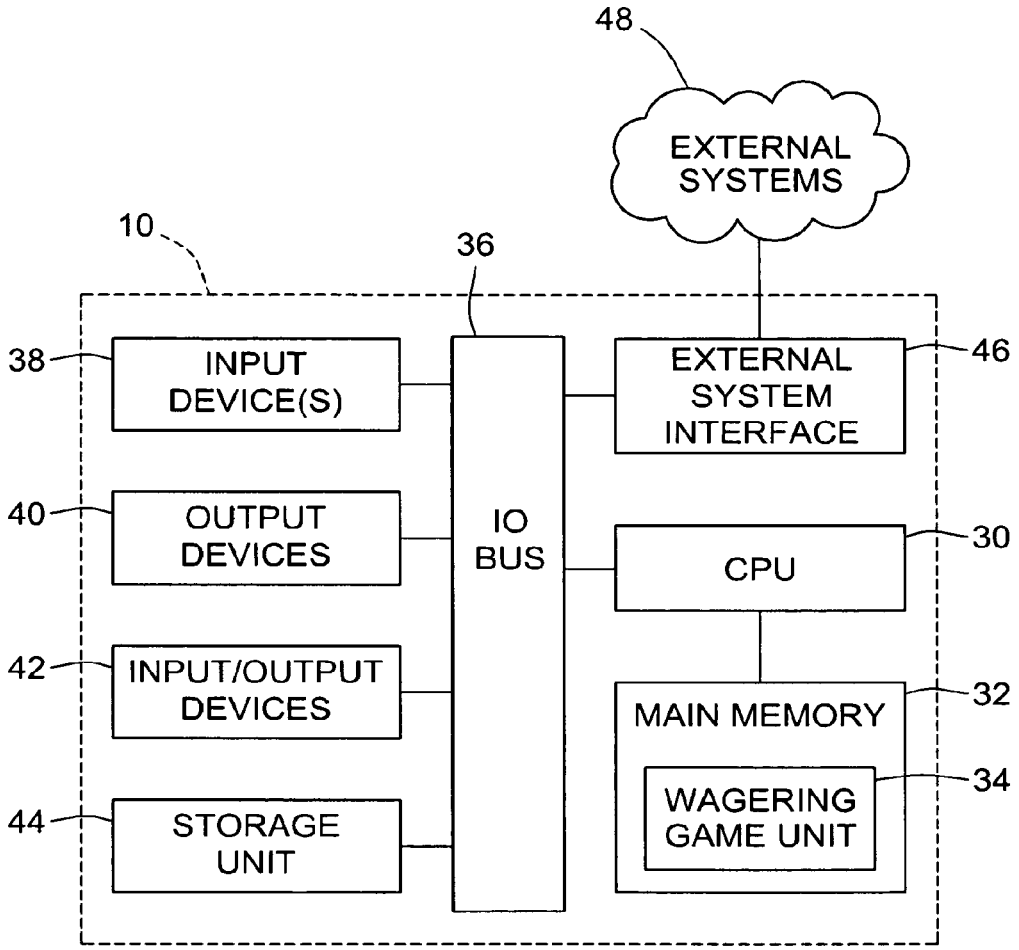
FIG. 2 PRIOR ART
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
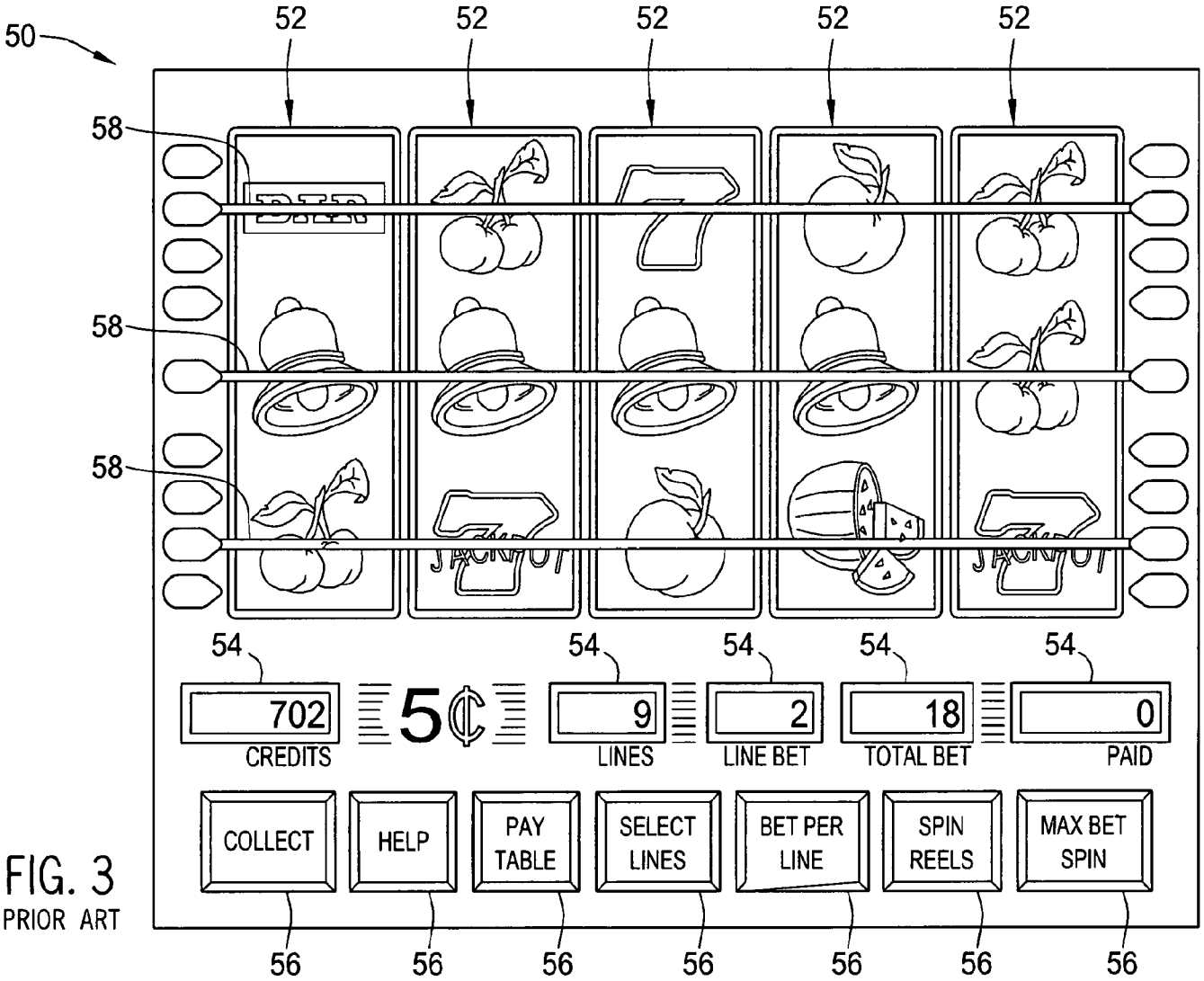
FIG. 3 PRIOR ART
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays an plurality of simulated symbol-bearing reels 52, with the reels 52 positioned in an array. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
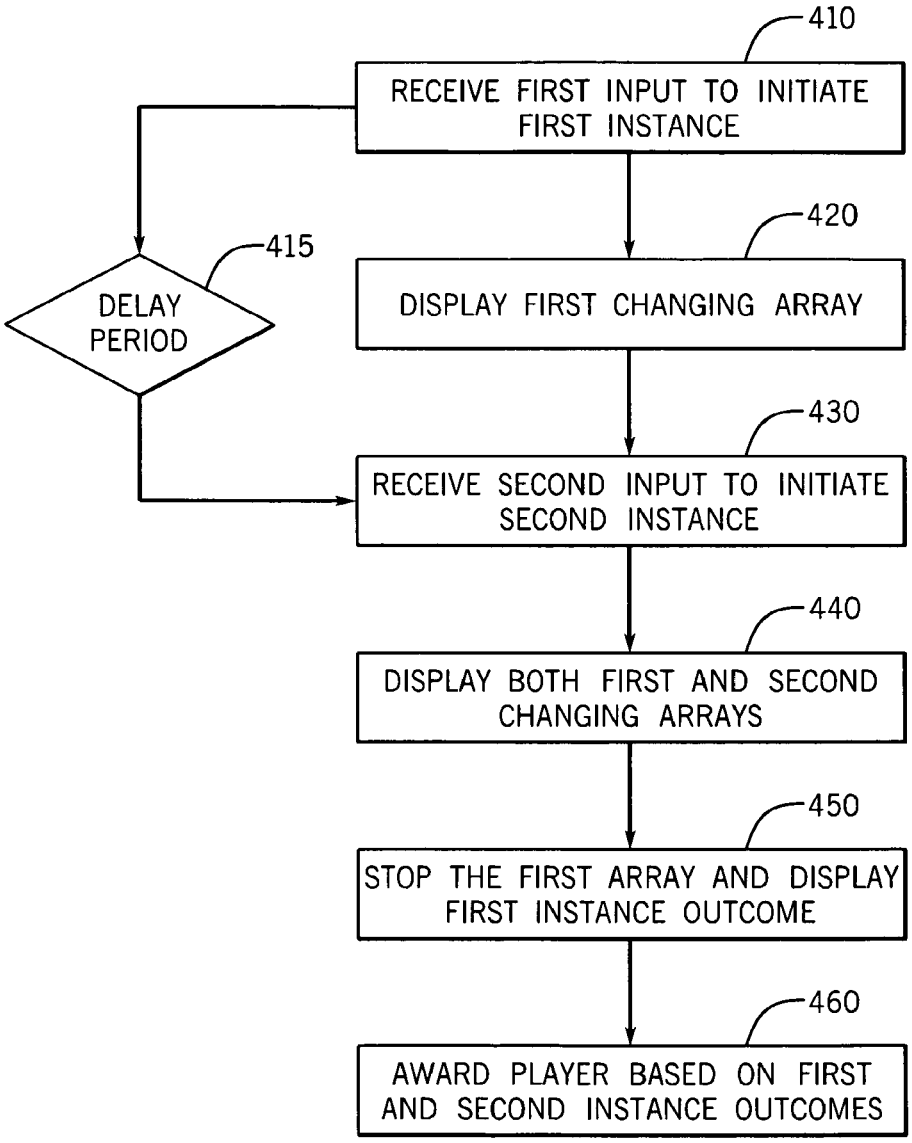
FIG. 4 is a flowchart for an algorithm that corresponds to instructions executed by a controller in accord with at least some aspects of the disclosed concepts.

Referring now to FIG. 4, there is shown a flowchart of an embodiment of the wagering game. At step 410, the wagering game receives a first wager input from the player to initiate a first instance of the wagering game, such as by making a wager. The first instance is represented by displaying a first changing array of symbols at step 420. The varying symbols of the first changing array exemplify the ongoing execution of the first instance, and the symbols of the changing array represent a plurality of possible outcomes for the first instance. After making a wager, the player determines how long to wait (step 415) before making a next wager. In this case, the player chooses to initiate another instance before the first instance has concluded, and so, at step 430, while the first instance is still executing, the wagering game receives a second wager input that initiates a second instance of the wagering game. The second instance is represented by displaying a second changing array of symbols, at step 440, concurrently with displaying the first changing array. As with the first instance, ongoing execution of the second instance is exemplified by the varying symbols of the second changing array. At step 450, the first array stops changing to display the symbol combination that represents the randomly selected first-instance outcome. Depending on the rules of the particular embodiment and on the delay period indicated by the player, the second instance may be still executing and the second changing array still displayed, or the second instance may stop changing at the same time as, or before, the first array stops. In either case, at step 460, the player is awarded based on both the first and second-instance outcomes.

It should be noted that, depending on the rate of play the player indicates (e.g., reducing the delay period will increase the player's rate of play), a third wagering-game instance, fourth instance, etc. may all be initiated prior to the stopping of the first array as will be explained in more detail with respect to FIG. 5. Further, the various game instances may continue changing for a constant length of time from their initiation or the length of time may vary based on events or outcomes randomly selected during the particular game instance. In embodiments where the length of time is variable, a latter game instance may stop and display the results prior to an earlier game instance. Alternatively, in constant-length embodiments, the instances of the wagering games will complete and display in the same order as they are initiated.

Figure 5:
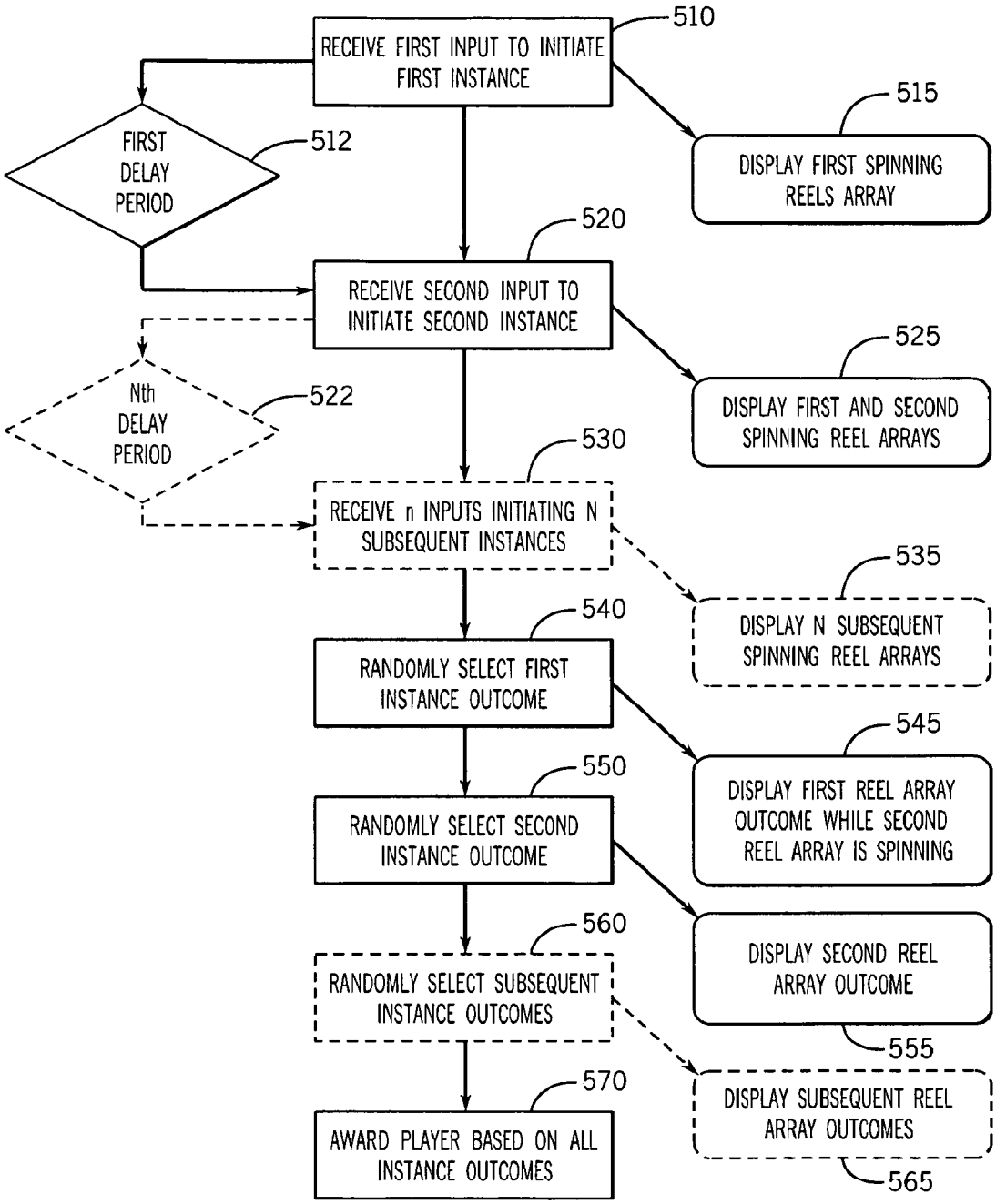
FIG. 5 is another flowchart for an algorithm that corresponds to instructions executed by a controller in accord with at least some aspects of the disclosed concepts.

FIG. 5 is a flowchart that illustrates another embodiment of the wagering game. In the embodiment of FIG. 5, the wagering game is a reel-type slot game and the arrays that represent the game instances comprise either mechanical or video reels. At step 510, the wagering game receives a first wager input from a player to initiate a first game instance of the wagering game, and at step 515 displays a first spinning reels array representing the executing first game instance. After the first wager input, the player determines how long of a delay period will precede the next wager and, at step 512, chooses a short delay period so that a second instance will initiate before the first instance has concluded. At step 520, the wagering game receives the player's second wager input and, at step 525, displays both the first and a second spinning reels array exemplifying the concurrent execution of the first and second game instances.

At step 530, the wagering may game continue to receive subsequent wager inputs (if any) that initiate separate, subsequent game instances and, at step 535, displays spinning reel arrays corresponding to each subsequent game instance. The player determines each delay period between subsequent wagers at step(s) 522, therefore the player controls the number of concurrently executing game instances.

At step 540, the wagering game randomly selects an outcome for the first instance, and stops the first spinning reels array to display the first-instance outcome at step 545. Similarly, an outcome for the second instance is selected, at step 550, and the second spinning reels array is stopped to display the second-instance outcome at step 555. Also similarly, any other game instances that have respective instance outcomes randomly selected in due time at step(s) 560, and their corresponding spinning reels arrays are stopped to display the outcomes at step(s) 565. It should be noted that game instances may execute for varying lengths of time, depending on the rules of the particular embodiment as well as other criteria. While game instances in some embodiments may conclude sequentially according to their order of initiation, other game instances may conclude earlier or later. At step 570, the wagering game awards the player based on the outcomes of all the wagering game instances of a gaming session. The awards of step 570 may be distributed throughout the gaming session so that the player receives awards in a piecemeal fashion (e.g., as each separate instance concludes).

Figure 6:
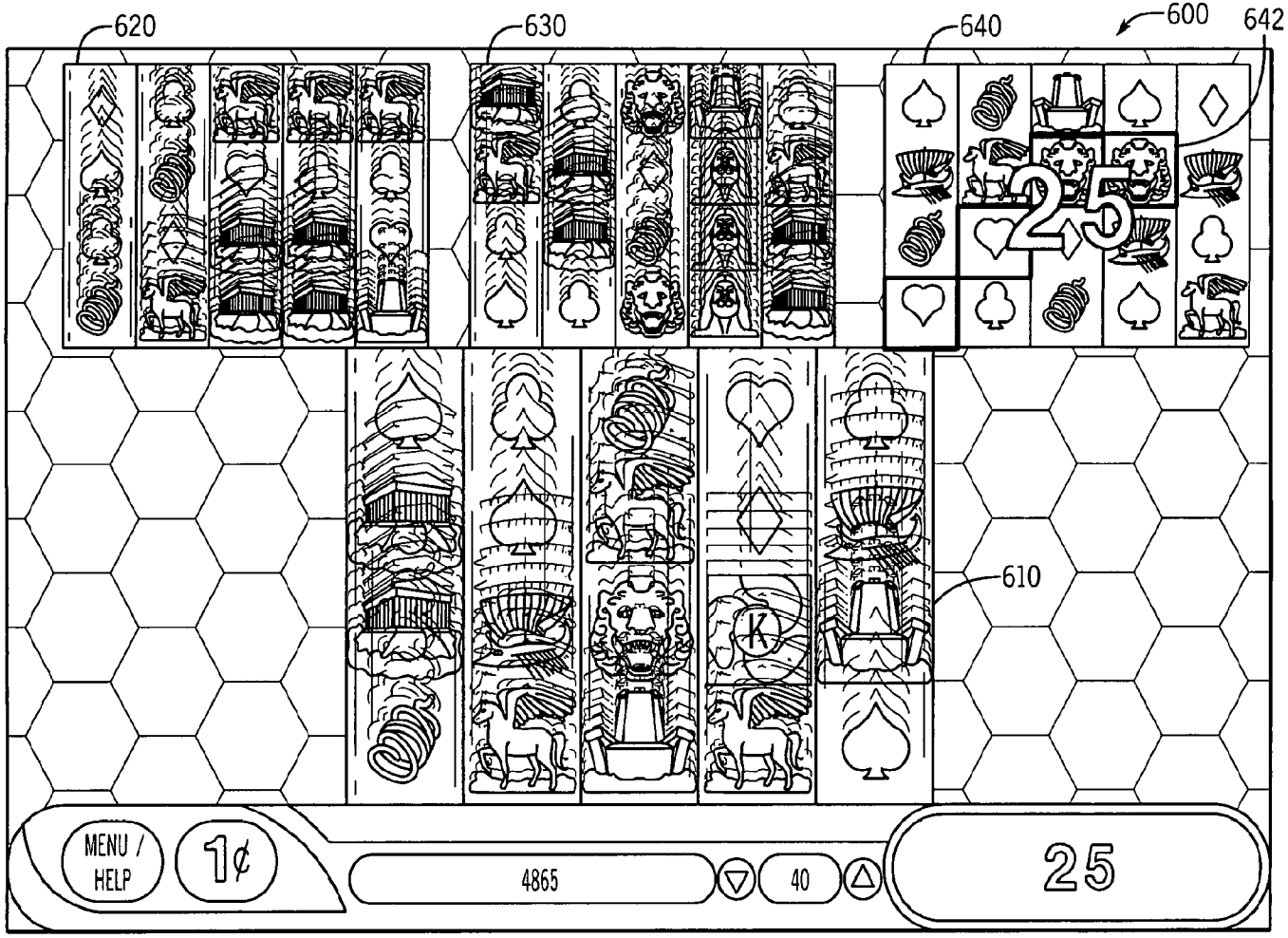
FIG. 6 is an image of an basic-game screen of an embodiment of the present invention that illustrates multiple changing arrays as well as a single stopped array representing separate instances of a wagering game.

Referring now to FIG. 6, there is shown an exemplary game screen 600 of an embodiment of the wagering game. The game screen 600 includes multiple arrays, each of the multiple arrays representing an individual instance of the wagering game. For example, a fourth instance (denoted by the changing array 610) is shown at a first, or primary, position of the game screen. The changing array 610 displays a plurality of varying, or spinning, symbols that represent a plurality of possible outcomes of the fourth instance. In contrast to the fourth instance, a first instance of the wagering (denoted by the stopped array 640) displays a plurality of symbols that represent a randomly selected outcome of the first instance. The stopped array 640 is shown positioned at a secondary position of the game screen, and may be sized differently (such as smaller than) an array at the primary position. Various other means and methods may be utilized to indicate primary, secondary, and tertiary positions, etc., or the different positions may be displayed without distinction. The stopped array 640 is evaluated according to a paytable of the wagering game and an award of 25 credits is awarded to the player as a result of the HEART-HEART-WILD-WILD (in this embodiment, the LION symbol is WILD) symbol combination along the payline 642.

Here and throughout this specification, game instances will be discussed as being represented by arrays of symbols. An array (as used herein) may be any ordered arrangement of separate symbols. In general, embodiments of the wagering game will present arrays that are configured according to the particular rules of the specific embodiment, and the specification fully envisions a variety of arrays that can implement the features and elements disclosed herein. One familiar type of array is a plurality of reels, either mechanical reels, video reels, or a combination of each. While the illustrated embodiment uses an array that is populated by rotating reels, the wagering game may, alternatively, include various other types of arrays of symbols, such as, cascading arrays and arrays of independently varying symbols, as well as variations and combinations thereof.

Game instances may be referred to as executing (or still-executing), as compared to a game instance that has halted. To help emphasize the distinction between executing and halted instances, the respective representative arrays may be described as changing arrays (e.g., an array of reels in which some or all reels are spinning) or stopped arrays. In some cases, the specification may, for convenience and brevity, refer to a changing instance or a stopped instance. In such cases, it will be clear that a changing instance is one whose representative array is changing (thus, still-executing) and a stopped instance is one whose representative array is stopped and displaying a randomly selected outcome of the instance.

As demonstrated by FIG. 6, multiple instances of the wagering game may be initiated and displayed while earlier-initiated instances are still executing. The changing arrays 610, 620, and 630 are indicative of game instances that are still executing, while stopped array 640 represents a game instance that has stopped executing and is displaying its randomly selected instance outcome so that the player can see what, if any, awards may result from the randomly selected outcome.

Wager Inputs

The wagering game may receive wager inputs from a player via various input devices. For example, a player at the gaming terminal 10 may provide wager inputs via buttons 20 on the button panel and via the touch screen 18, as well as via a mouse, joystick, gesture-sensing device, etc. The wagering game is capable of receiving wager inputs in rapid succession, more slowly, and with varying delay periods between inputs. In one embodiment, a player may maintain a button or other input device in a particular position to cause the wagering game to receive continuous wager inputs and to initiate new wagering-game instances as quickly as possible.

A gesture-sensing device may be adapted to detect a motion or gesture by the player and to transmit a wager input signal based on the detected gesture. For example, the gesture-sensing device may detect a waving or pointing gesture of the player and, in response, transmit a wager input to the wagering game. Alternatively, the player may stroke or brush a touchscreen with a fingertip to "fling" a new game instance onto the game screen—the new game instance being represented by a changing array that appears to fly onto the game screen as if controlled by the speed and/or direction of the fingertip movement. In some embodiments, the player may be able to initiate multiple instances with each wager input, and the number of instances may be determined by the player. The specification envisions various means and methods of generating wager inputs in ways that engage the player's imagination and increase the player's immersion in the wagering game.

Variable-Speed Instance Initiation

Significantly, the time between initiating new instances is determined by the player and may vary irregularly according to the player's whim and desired rate of play. As such, the wagering game may provide the player with a sense of control while sustaining the player's excitement as the various instances transition from changing arrays, randomly selected instance outcomes, and any awards associated with each instance outcome.

In some embodiments, the player may exercise full control over the rate that new game instances are initiated and displayed by the wagering game. Following each wager input, a delay period before the next wager input is determined by the player. For example, a player may choose to play with only one or two concurrently executing game instances so that the player can easily follow each instance as it progresses. As such, the player may wait until at least one changing array stops to display an instance outcome before making another wager to initiate a new instance. Alternatively, a player may choose to wager at a rate that provides a large number of concurrently executing instances. Also, of course, the player can slow down and speed up their wagering rate with each wager simply by varying the delay period between wager inputs. Different embodiments may be configured to provide benefits for various wagering rates and may encourage different wagering rates depending on a past, present, or anticipated state of the wagering game. In this way, the wagering game aims to capture the player's attention and excite their anticipation of a potential big jackpot.

Array Positioning

Figure 7:
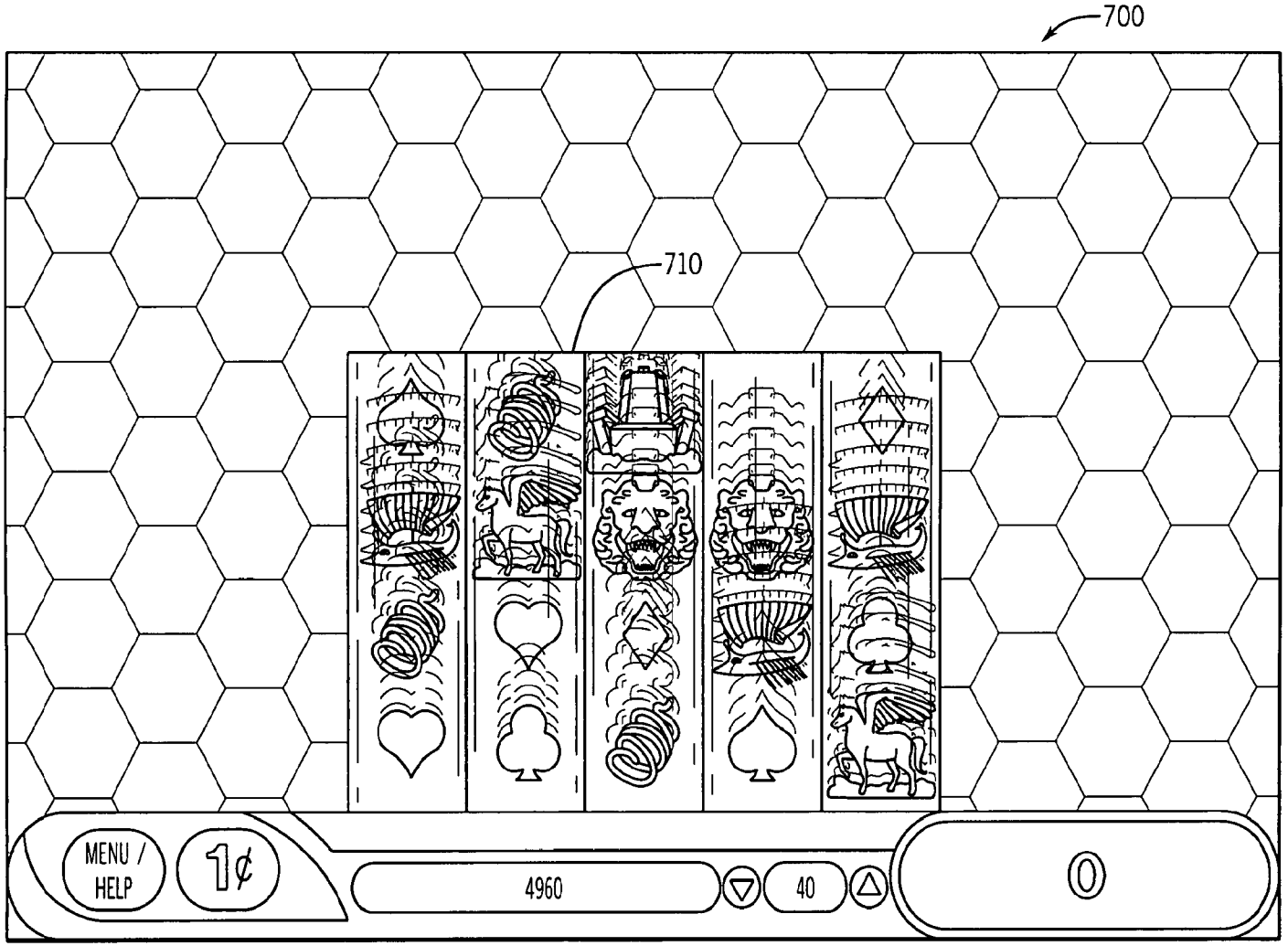
FIG. 7 is an image of a basic-game screen showing an initial changing array at a primary position representing an executing instance of a wagering game.

Referring now to FIG. 7, an initial game screen 700 of an embodiment of the wagering game is shown displaying a first changing array 710 at a first position. A solitary array at the first position may be shown after receipt of a first wager input of a gaming session, upon receipt of a wager input after all previous instances have concluded (and been removed from the display), or at other times as determined by the wagering game rules. After providing a wager input to the wagering game that initiates a first instance, a player may wait for the first instance to conclude and to award any achieved awards before wagering again. Alternatively, the player may choose to initiate multiple instances in sequence while previous instances are still executing.

Figure 8:
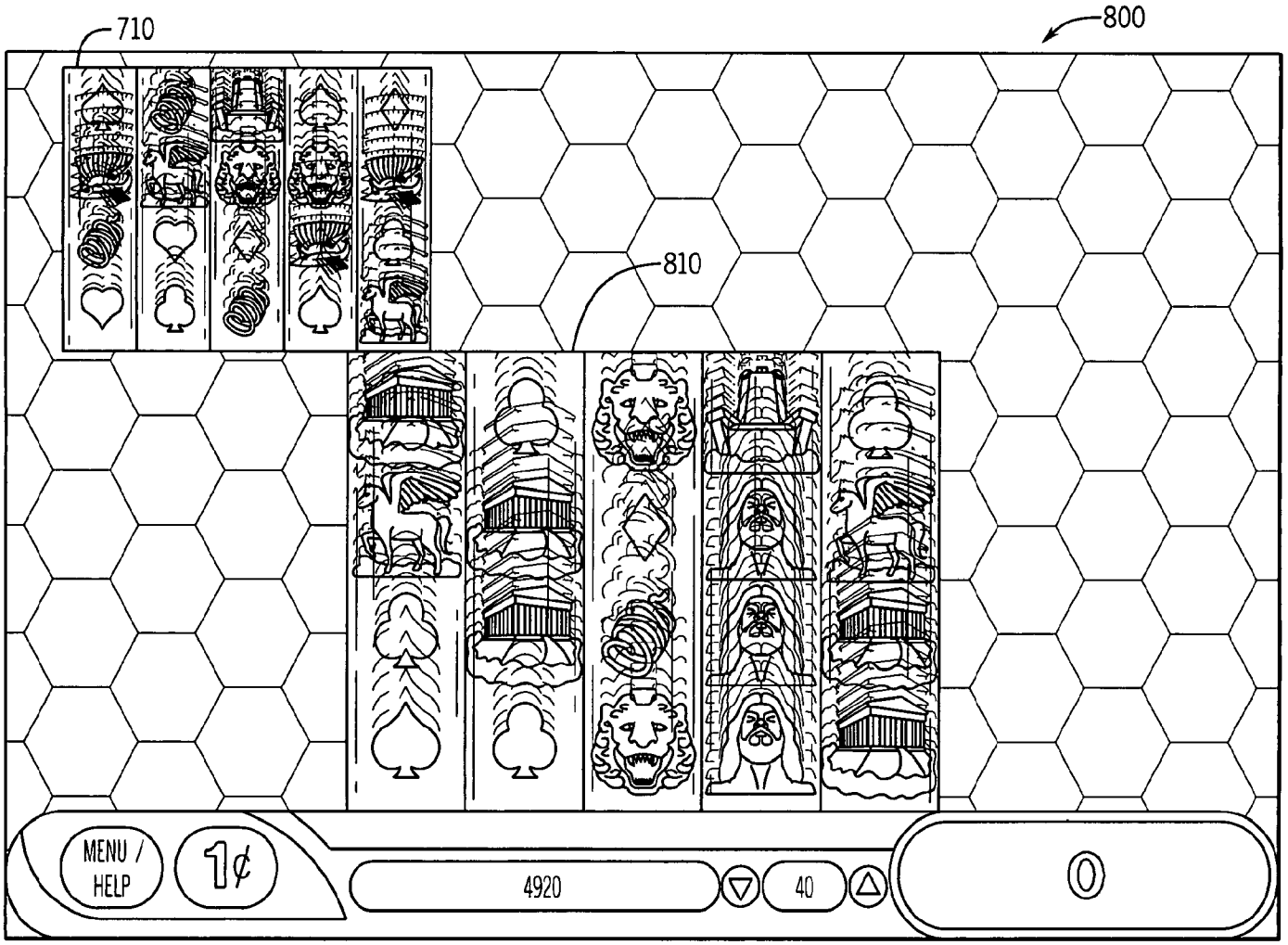
FIG. 8 is an image of a basic-game screen showing a first subsequent changing array at the primary position that has displaced the initial changing array to a secondary position.
Figure 9:
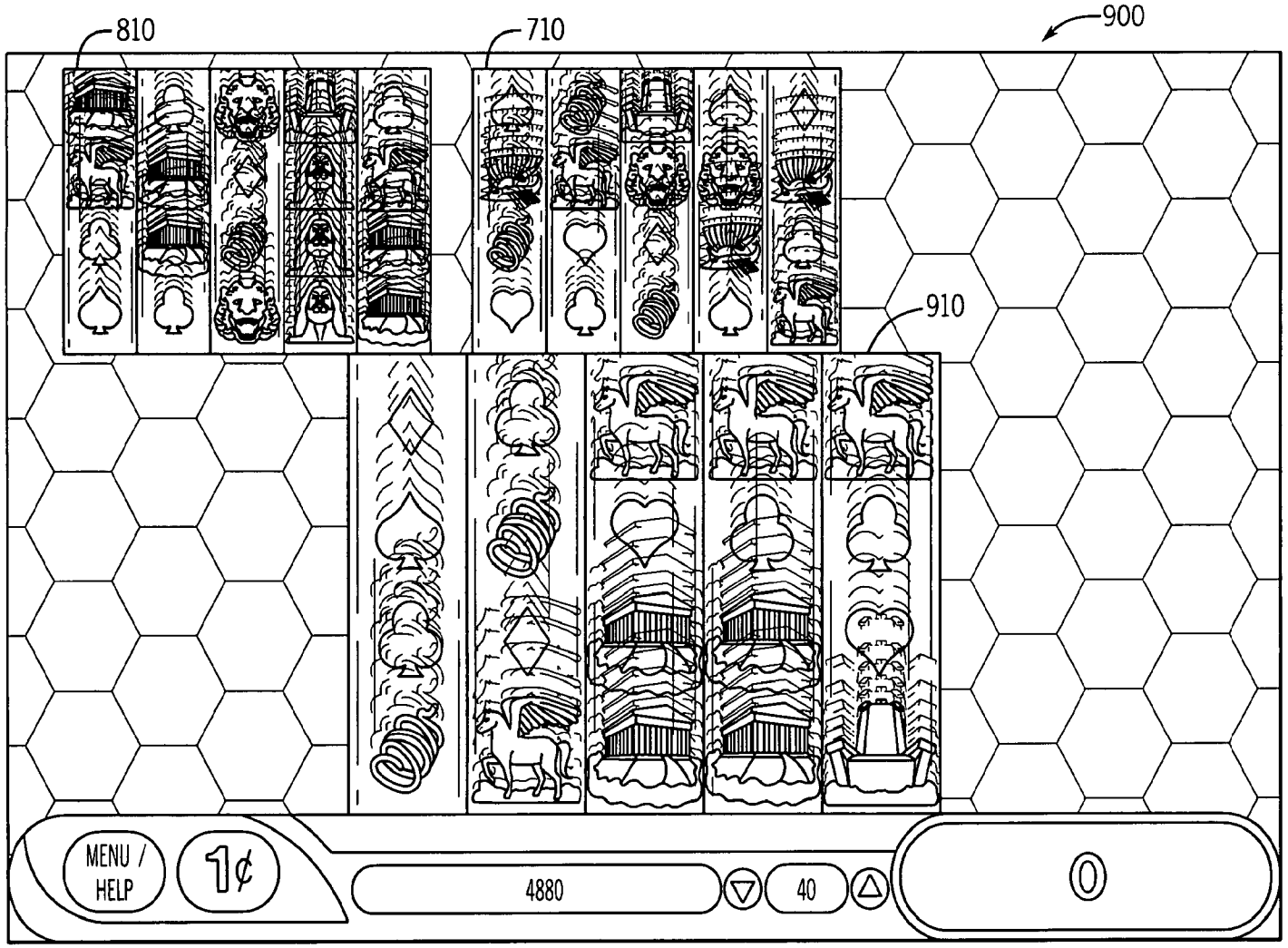
FIG. 9 is an image of a basic-game screen showing a second subsequent changing array at the primary position as well as two previously initiated changing arrays at secondary positions.

Referring now to FIGS. 8 and 9, game screens 800 and 900 show, respectively, the wagering game after initiation of a second instance (changing array 810) and a third instance (changing array 910)—and wherein the second and third instances have been initiated before the first instance (changing array 710) has finished executing. When the player inputs their wagers quickly, executing instances can accumulate on the screen while they are advancing towards their individual conclusions. The player may input wagers as quickly as possible and nearly fill the entire screen with still-changing arrays.

The wagering game may display the multiple instances in various other ways. For example, the subsequent instances may be represented by arrays that are stacked vertically. Alternatively, the subsequent arrays may wrap around a centrally located primary position that displays the most recently initiated game instance. Preferably, the most recently initiated instance will be displayed in a fashion that distinguishes it from previously initiated arrays, however, in some embodiments the most recently initiated instance is not recognizably different from other, earlier-initiated instances. Additionally, in the event of a bonus event or feature being triggered in one of the game instances, the regular display mode may be interrupted to focus attention on the bonus event. Execution of any still-executing game instances may be paused during a bonus event and resume after the bonus event is concluded, or the other instances may continue executing concurrently with the bonus event.

A mode of displaying game instances may vary depending on how many instances are concurrently displayed as well as in response to a wagering rate at which new instances are initiated. As more arrays are concurrently displayed, the arrays may shrink in size to allow space for new arrays. Alternatively, the arrays may overlap (for example, as in a conventional cascade display mode) to allow multiple arrays to be displayed on the game screen. Various other modes of displaying multiple instances are envisioned by the specification.

In one embodiment, the most recently initiated instance is shown in a recognizable primary position. In FIG. 8, changing array 810 displaces changing array 710 from the primary position to a secondary position upwards and to the left of the screen. Similarly, in FIG. 9, changing array 910 displaces changing array 810 from the primary position, and 810 in turn further displaces 710 to the center of the game screen. A next subsequent wagering input may result in a game screen similar to FIG. 6 with the most recent instance in the primary position and three previous instances (some executing 620, 630, some possibly concluded 640) extending across the top of the screen.

As a displayed game instance reaches a conclusion, for example, when a changing array stops to display a randomly selected instance outcome, the array may be removed from the game screen. Again, the method of array removal may vary from one embodiment to another, and may depend on different criteria such as a number of concurrently executing instances and screen size, as well as the gaming rules of any particular embodiment. In some embodiments, each instance is displayed at least to its conclusion, and, in even further embodiments, any award resulting from an instance outcome is clearly displayed to a player while the array is on the game screen.

Figure 10:
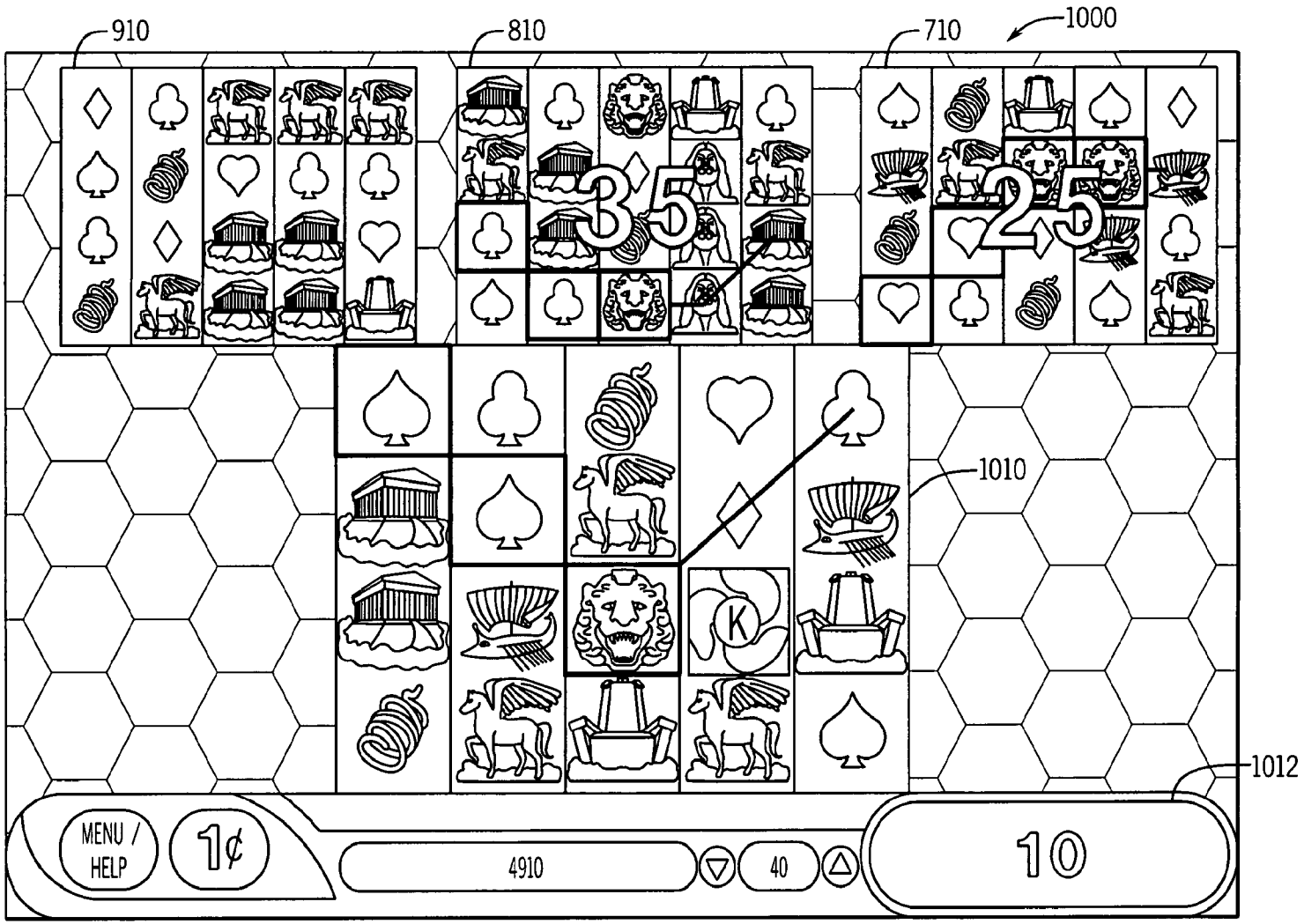
FIG. 10 is an image of a basic-game screen showing four stopped arrays displaying the randomly selected instance outcomes of four separate instances of a wagering game.

Referring now to FIG. 10, the game screen 1000 shows all current game instances have concluded. Game instances 710, 810, and 1010 display winning symbol combinations resulting in awards of 25, 35, and 10 credits, respectively. Game instance 910 has no winning combinations and provides no award to the player. As illustrated, the award amounts for game instances 710 and 810 are displayed atop of the respective array, whereas the award amount for the last initiated game instance 1010 is displayed in the main win meter 1012 during the evaluation of game instance 1010.

Game screens that display both current and previously initiated game instances provide a historical view of game play and a player who can view their history of past and currently executing instances may find patterns that seem to suggest certain actions or to indicate impending events. For example, if the player has previously won big jackpots on WINGED HORSE symbols, they may interpret a lack of WINGED HORSE symbols in the previous instances as an indication of upcoming WINGED HORSE symbols and increase their wager amounts for subsequent instances. In a similar fashion, a player who has just won a sizable award may slow down their wagering rate until the game gets "hot" again.

As will be discussed later in this disclosure, variable-speed initiation of multiple concurrent wagering game instances can affect the outcomes of the instances in such ways as to produce a sense of urgency, anticipation, and increased opportunity. The wagering game may provide subtle and explicit "clues" related to future instances that a player may interpret as being favorable to increased wager amounts or a higher wagering rate.

Array Interactions

While displaying multiple game instances, the wagering game provides interactions between respective arrays that may affect paytables, instance outcomes, and awards associated with instance outcomes. For example, in FIG. 8, WILD symbols or other high value symbols may migrate between changing arrays 710 and 810. In one embodiment, clumped symbols on one changing array may fill an entire column of an array and cause the same column of another array to change to WILD symbols. Symbol transfers may flow between a stopped array and a changing array, between concurrently changing arrays, only from a changing array to another array, and in other ways according to various wagering game rules.

An award or a bonus feature may be dependent on one or more symbols occurring on multiple concurrent arrays without requiring that the symbols be transferred from one array to another. For example, the concurrently displayed arrays in one embodiment may include randomly occurring, fixed symbols (e.g., WILD symbols that are displayed in place while the arrays are still changing). If a player achieves at least one of the fixed symbols in each displayed array or in at least a minimum number of arrays, a special award or bonus feature may be triggered. Similar benefits may be awarded for symbol clumps and for symbols on stopped arrays that are concurrently displayed.

Variations and combinations of the abovementioned array interactions, as well as other array interactions, are envisioned as being implemented in embodiments of the wagering game. Array interactions may be extended to stopped arrays representing game instances that have halted or paused, as a way to provide additional or second-chance awards.

For example, a particular changing array may spawn WILD symbols that transfer to any displayed array, whether changing or stopped, so that the WILD symbols may be evaluated (or re-evaluated) in the receiving array. Any WILD symbols that land on a changing array may be duplicated on one or more displayed stopped arrays and result in the stopped arrays being re-evaluated for additional awards. In an exemplary case, a WILD symbol that appears in the second column of a changing array in the primary position retroactively appears in the third column of a stopped array in a secondary position. The introduction of the WILD symbol to the stopped array may create a new winning symbol combination in the stopped array. In response, the stopped array is re-evaluated and the award associated with the stopped array increases from 10 credits to 50 credits. In one embodiment, the duplicated symbols may appear in any or all of the currently displayed arrays, so that a player having several concurrently displayed arrays may have an equal number of opportunities for additional awards. For example, if the player is wagering at a rate that maintains 5 arrays on the screen, the WILD symbol may be duplicated on each of the five arrays and possibly result in 5 or more additional awards.

Increased Benefits for Concurrently-Displayed Changing Arrays

The wagering game may provide enhanced benefits to a player for a wager rate (i.e., how fast the player enters wager inputs) that results in multiple, concurrently executing instances, and may further reward the player for sustaining a minimum wagering rate or wagering rate range over time. In one embodiment, in which multiple changing arrays are positioned in a vertical stack, increasing the height of the stack (by initiating more instances) may provide opportunities for enhanced awards such as more beneficial symbol transfers between arrays, progressive jackpots, or advantageous probability adjustments. The same or similar benefits may be provided for higher wager amount, also.

Other embodiments may enhance benefits of various types, including credit awards, additional and more frequent bonus features, unlocking features, and modifying outcome probabilities such as expected values, in response to an increased or sustained wager rate. In one embodiment, scatter symbols that trigger bonus features may be increased on one or more executing instances when a player maintains a minimum number of concurrently changing arrays. Also, by increasing the number of concurrently executing instances (say, increasing above the minimum), a player may be provided even more scatter symbols or may simply increase the probability of achieving a scatter symbol. In another embodiment, scatter or line symbols may award mystery bonus jackpots and may trigger hidden bonus features. Yet another embodiment may change the requirements for achieving a bonus feature or an award, For example, when only one instance is executing, three scatter symbols may be required to trigger a particular bonus feature. However, if the player has three concurrently executing game instances the same bonus feature may be triggered by an occurrence of only two scatter symbols. Thus, in this exemplary embodiment, the player is encouraged to maintain more concurrently executing game instances.

Sneak-Peek Feature

In one embodiment of the wagering game, initiating or maintaining a plurality of still-executing instances may enable a "sneak-peek feature" that provides the player with information about impending instances of the wagering game, that is, information regarding one or more instances that will be initiated by the next subsequent wager inputs. For example, when a player has two game instances executing concurrently, an additional "sneak-peek" changing array may be displayed on the game screen. The sneak-peek array represents the next instance that will be initiated by the next wager input. The sneak-peek array may include WILD symbols at fixed positions within the changing array, visible clumps of WILD and other high-value symbols, and other enhancements that affect the apparent value of the impending array. By giving the player a glimpse into the future, the wagering game provides additional encouragement to submit another wager to lock-in the perceived advantages of the sneak-peek array.

Figure 11:
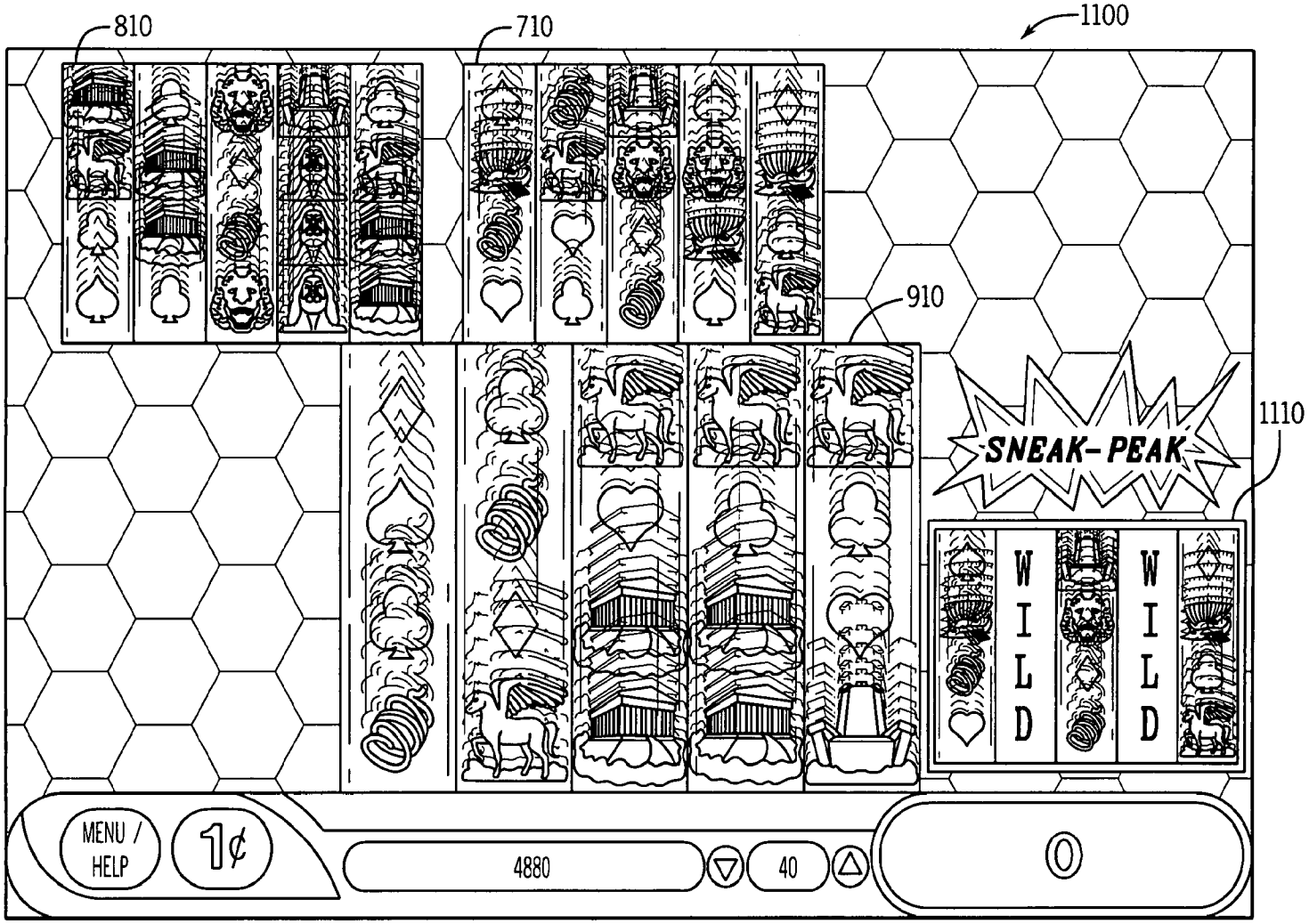
FIG. 11 is an image of a basic-game screen showing three changing arrays representing currently executing instances of a wagering game as well as an impending changing array representing the wagering game instance that will be initiated by the next wager input.

Referring now to FIG. 11, the game screen 1100 illustrates one embodiment of the wagering game that includes a "sneak-peak feature." In the embodiment of FIG. 11, the player currently has three concurrently executing game instances represented by changing arrays 710, 810, and 910. In addition, the wagering game displays a sneak-peak array 1110. Array 1110 represents the next game instance, in other words, the game instance that will be initiated if the player enters the next wager while the three concurrently executing game instances are still executing. As shown FIG. 11, the sneak-peek array has two fixed WILD columns that may significantly increase the probability of a big award, and thus the sneak-peek array provides an incentive for the player to quickly enter the next wager before any of the still-executing arrays concludes. The sneak-peek array may be removed when any of the concurrently executing game instances reaches its conclusion.

A sneak-peek feature may increase and diminish with the player's wagering rate. A player who achieves more concurrently executing game instances may be provided with a second sneak-peek array, or even a third. A player who maintains a number of concurrently executing game instances over a designated period of time may also receive additional information regarding impending instances. Similarly, as executing instances conclude and reduce the number of concurrently executing game instances, one or more sneak-peek arrays may disappear from view.

Various future-looking benefits are envisioned by the specification in addition to or in place of sneak-peek arrays. Fixed-WILD symbols or clumped symbols displayed on a sneak-peek array may multiply to cover additional symbol positions in response to additional executing instances or extended time of execution. Special scatter symbols may be displayed or announced to encourage the player to maintain a minimum wagering rate. Fixed-WILD symbols indicative of impending instances may be displayed on currently displayed arrays as ghosts or overlaid symbols instead of displaying an additional sneak-peek array.

Delayed Spin-Down

In an embodiment of the wagering game, multiple game instances may be initiated in quick succession so that several still-executing instances are concurrently displayed as changing arrays. The arrays may continue spinning until an additional input from the player is received to initiate a spin-down process in which each of the executing instances transitions to conclusion. For example, in an embodiment in which the instances are represented by arrays of reels, the reels may be displayed as spinning steadily until the additional input is received, and then gradually slowing down until the reels come to a stop to display a randomly selected instance outcome. Additionally, the reels of a given array may stop individually—one at a time—so that the player experiences increasing anticipation as the symbol combination of the randomly selected outcome is increasingly revealed. Some embodiments may provide a prolonged "anticipation sequence" that includes any or all of special sound effects, music, and visual effects to enhance the player's anticipation of the final reels.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A computer-implemented method of serially initiating multiple instances of a wagering game, at least two of the multiple instances executing concurrently while being concurrently displayed to a player, each instance of the wagering game including a wagering game instance outcome that is randomly selected via at least one of one or more processors, the method comprising:

receiving, via at least one of one or more input devices, a first input indicative of a wager that initiates a first instance of the wagering game;

displaying, via at least one of one or more display devices, a first changing array of symbols representing a plurality of possible first-instance outcomes, the first changing array being displayed at a primary position on the at least one of the one or more display devices;

prior to displaying a randomly selected first-instance outcome of the first instance and after a first delay period following the initiation of the first instance, receiving, via at least one of the one or more input devices, a second input indicative of a wager that initiates a second instance of the wagering game, wherein the first delay period is a length of time passing between receipt of the first input and the second input indicative of wagers;

displaying, via at least one of the one or more display devices, a second changing array of symbols representing a plurality of possible second-instance outcomes, wherein the second changing array is displayed concurrently with the first changing array and wherein displaying the second changing array includes automatically moving the first changing array from the primary position to a secondary position on at least one of the one or more display devices and displaying the second changing array at the primary position.

2. The computer-implemented method of claim 1, further comprising:

randomly selecting, via at least one of the one or more processors, the first-instance and second-instance outcomes;

stopping, via at least one of the one or more processors, the first changing array to display the symbols representing the selected first-instance outcome;

stopping, via at least one of the one or more processors, the second changing array to display symbols representing the selected second-instance outcome; and awarding, via at least one of the one or more processors, the player based on the selected first-instance and second-instance outcomes.

3. The computer-implemented method of claim 1, further comprising:

while displaying the first and second changing arrays, displaying an impending changing array at a sneak-peek position; and after receiving, via at least one of one or more input devices, a third input indicative of a wager to initiate a third instance of the wagering game, displaying the impending changing array at the primary position and moving the second changing array to a secondary position.

4. The computer-implemented method of claim 3, wherein the impending changing array includes one or more patterns of symbols that are predictive of a third-instance outcome of the third instance.

5. The computer-implemented method of claim 1, wherein an expected value of the first instance is increased in response to receiving the second input prior to displaying the randomly selected first-instance outcome.

6. The computer-implemented method of claim 1, wherein a paytable associated with the first instance is changed in response to receiving the second input prior to displaying the randomly selected first-instance outcome.

7. The computer-implemented method of claim 1, further comprising transferring symbols from the first array to the second array prior to awarding the player based on the selected second-instance outcome.

8. The computer-implemented method of claim 1, further comprising transferring one or more symbols from the first-instance outcome to the second changing array prior to displaying the second-instance outcome.

9. A gaming system configured to conduct a wagering game including multiple instances executing concurrently and being concurrently displayed to a player, each instance of the wagering game including a randomly selected instance outcome, the gaming machine comprising:

one or more input devices;

one or more display devices;

one or more processors; and one or more memory devices storing instructions that, when executed by at least one of the one or more processors, cause the gaming system to:

receive, via at least one of the one or more input devices, a first input indicative of a wager that initiates a first instance of the wagering game;

display, via at least one of the one or more display devices, a first changing array of symbols representing a plurality of possible first-instance outcomes, the first changing array being displayed at a primary position on the at least one of the one or more display devices;

prior to a random selection of a first-instance outcome of the first instance and after a first delay period following the initiation of the first instance, receive, via at least one of the one or more input devices, a second input indicative of a second wager that initiates a second instance of the wagering game, wherein the first delay period is a length of time passing between receipt of the first input and the second input indicative of wagers;

display, via at least one of the one or more display devices, a second changing array of symbols representing a plurality of possible second-instance outcomes, wherein the second changing array is displayed concurrently with the first changing array and wherein displaying the second changing array includes automatically moving the first changing array from the primary position to a secondary position on at least one of the one or more display devices and displaying the second changing array at the primary position.

10. The gaming system of claim 9, wherein moving the first changing array from the primary position to the secondary position further includes reducing the size of the first changing array.

11. The gaming system of claim 9, wherein at least one of the first and second inputs is a gesture-based input that signifies movement from the primary position to the secondary position.

12. A computer-implemented method of conducting a wagering game that includes multiple instances of the wagering game executing concurrently while being concurrently displayed to a player, each instance of the wagering game including a wagering game instance outcome that is randomly selected via at least one of one or more processors, the method comprising:

receiving, via at least one of one or more input devices, a first input indicative of a wager that initiates a first instance of the wagering game;

displaying, via at least one of one or more display devices, the first instance including a changing first array of symbols representing a plurality of possible first-instance outcomes, the first instance being displayed at a primary position on the at least one of the one or more display devices;

prior to randomly selecting a first-instance outcome of the first instance and after a first delay period following the receipt of the first input, receiving, via at least one of the one or more input devices, a second input indicative of a wager that initiates a second instance of the wagering game;

displaying, via at least one of the one or more display devices, the second instance including a changing second array of symbols representing a plurality of possible second-instance outcomes, wherein the display of the second instance begins while the first array is still changing and wherein the second instance is automatically displayed at the primary position and the first instance is moved to a secondary position on at least one of the one or more display devices;

stopping, via at least one of the one or more processors and while the second array continues changing, the first array to display a first symbol combination representing the randomly selected first-instance outcome;

stopping, via at least one of the one or more processors, the second array to display a second symbol combination representing the randomly selected second-instance outcome, and awarding the player based on the first symbol combination and the second symbol combination.

13. The computer-implemented method of claim 12, wherein the first delay period is determined by a length of time passing between the first and second inputs.

14. The computer-implemented method of claim 12, wherein a first paytable corresponding to the first instance changes in response to receiving the second input before the random selection of the first-instance outcome.

15. The computer-implemented method of claim 12, wherein a first expected value of the first instance increases in response to receiving the second input before the random selection of the first-instance outcome.

16. The computer-implemented method of claim 12, further comprising, prior to the random selection of the first and second-instance outcomes, receiving, via at least one of the one or more input devices and after a second delay period following the initiation of the second instance, a third input indicative of a wager that initiates a third instance of the wagering game, and wherein a first expected value of the first instance and a second expected value of the second instance both increase in response to receiving the third input before the random selection of the first and second-instance outcomes.

17. The computer-implemented method of claim 12, wherein one or more symbols of the first symbol combination are copied to the second symbol combination prior to awarding the player based on the second symbol combination.

18. The computer-implemented method of claim 12, further comprising transferring symbols from the first array to the second array prior to awarding the player based on the selected second-instance outcome.

19. The computer-implemented method of claim 12, further comprising:

while displaying the first and second changing arrays, displaying an impending changing array at a sneak-peek position; and after receiving, via at least one of one or more input devices, a third input indicative of a wager to initiate a third instance of the wagering game, displaying the impending changing array at the primary position and moving the second changing array to a secondary position.

20. The computer-implemented method of claim 19, wherein the impending changing array includes one or more patterns of symbols that are predictive of a third-instance outcome of the third instance.

* * * * *